United States Patent [19]

Ferrero

[11] Patent Number: 4,588,078

[45] Date of Patent: May 13, 1986

[54] PACKAGE FOR FOOD PRODUCTS, PARTICULARLY SWEET PRODUCTS

[75] Inventor: Pietro Ferrero, Brussels, Belgium

[73] Assignee: Ferrero S.p.A., Alba, Italy

[21] Appl. No.: 698,848

[22] Filed: Feb. 6, 1985

[30] Foreign Application Priority Data

Feb. 6, 1984 [IT] Italy ..... 52950[U]
Nov. 27, 1984 [IT] Italy ..... 54087[U]

[51] Int. Cl.[4] ..... B65D 85/72; B65D 85/78; B65D 81/32

[52] U.S. Cl. ..... 206/216; 206/548; 206/484; 206/526

[58] Field of Search ..... 206/216, 484, 526, 548, 206/568, 459; 215/246; 229/87 F

[56] References Cited

U.S. PATENT DOCUMENTS

| | | | |
|---|---|---|---|
| 1,438,487 | 12/1922 | Greene | 206/484 |
| 2,318,557 | 5/1943 | Miller | 206/216 |
| 2,791,324 | 5/1957 | Knoop et al. | 206/484 |
| 3,155,282 | 11/1964 | LeBlanc | 206/484 |
| 3,184,121 | 5/1965 | Volckening | 206/484 |
| 3,521,805 | 7/1970 | Ward | 206/484 |
| 3,650,391 | 3/1972 | Chung | 206/526 |
| 4,230,224 | 10/1980 | Weeks | 206/94 |
| 4,314,650 | 2/1982 | Cillario | 206/526 |
| 4,387,809 | 6/1983 | Botzler | 206/216 |
| 4,465,190 | 8/1984 | Cillario | 206/216 |

FOREIGN PATENT DOCUMENTS

| | | | |
|---|---|---|---|
| 2107795 | 8/1972 | Fed. Rep. of Germany | 206/484 |
| 2324844 | 12/1974 | Fed. Rep. of Germany | 206/216 |
| 2006713 | 5/1979 | United Kingdom | 206/459 |

OTHER PUBLICATIONS

"Skintight" advertisement, 8/1979.

*Primary Examiner*—William Price
*Assistant Examiner*—Brenda J. Ehrhardt
*Attorney, Agent, or Firm*—Bernard, Rothwell & Brown

[57] ABSTRACT

A package for food products comprises a first container and a second container, which are filled respectively with a solid or solidifiable food product and a food product which can be used as a garnishing for the solid or solidifiable product.

The first container is generally dish-shaped and has a rim with at least one straight side, and a straight edge located adjacent the bottom of the container and parallel to the straight side of the rim. The straight side and edge together define a flat side face of the first container.

The second container is generally flat and has dimensions such as to allow it to be applied against the flat side face of the first container. The second container is at least partly compressible in order to expel the garnishing product contained therein.

The containers have an associated tubular wrapper which can be fitted onto the first container with the second container applied to the flat side face in an arrangement whereby one section of the wrapper extends between the straight side of the rim and the straight edge to cover the second container.

16 Claims, 13 Drawing Figures

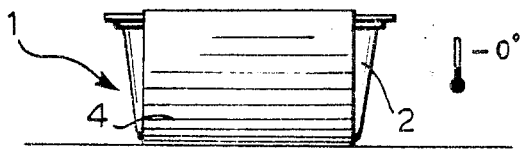
FIG. 5
FIG. 6
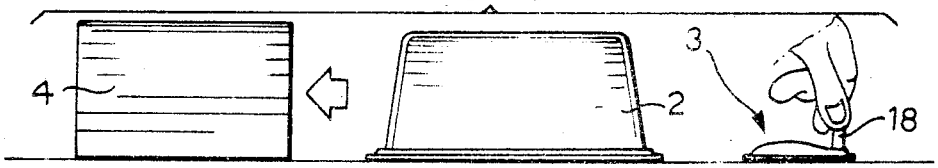
FIG. 7
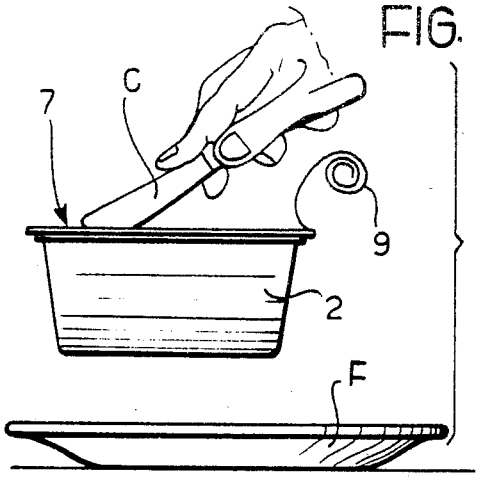
FIG. 8
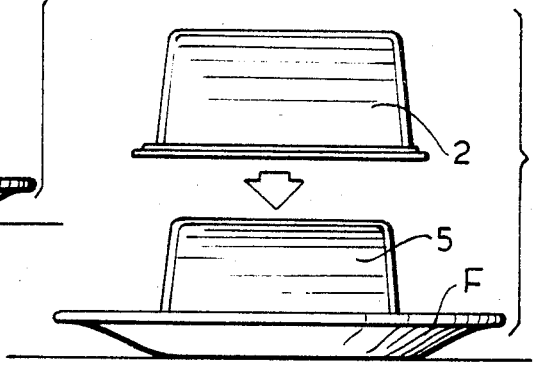
FIG. 9
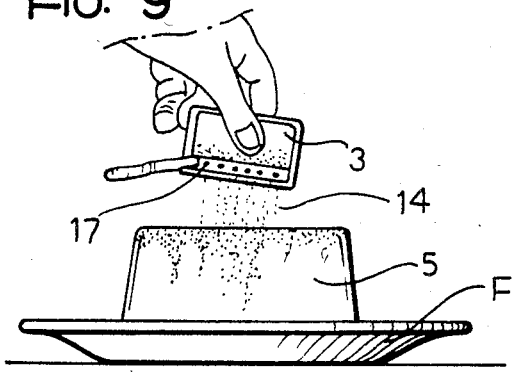

PACKAGE FOR FOOD PRODUCTS, PARTICULARLY SWEET PRODUCTS

The present invention relates to packages for food products and is particularly concerned with a package including first and second containers for respective fillings of a solid or solidifiable food product and a food product usable as a garnishing for the solid or solidifiable product.

A package of the type described is illustrated, for example, in Italian utility model application No. 53546-B/82 by the same Applicants. The package according to the invention is characterised in that:

the first container is generally dish-shaped and has a rim with at least one straight side, and a straight edge located adjacent the bottom of the container and parallel to the streight side of the rim, the straight side and edge together defining a flat side face of the first container;

the second container is generally flat and has dimensions such as to allow it to be applied against the flat side face of the first container, the second container being at least partly compressible in order to expel the garnishing product contained therein, and the containers have an associated tubular wrapper which can be fitted onto the first container with the second container applied to the flat side face in an arrangement such that one section of this wrapper extends between the straight side of the rim and the straight edge to cover the second container.

By virtue of this characteristic, a package for food products is formed which is especially practical and is particularly easy to use when the first container is filled with a liquid or semi-liquid food product which can be solidified by cooling, and the second container is filled with a powdered garnishing.

According to one application which is preferred at present, the first container is filled by a milk-and cream-based product which can be solidified by cooling and, after solidification, takes on characteristics much the same as those of conventional ice-cream products. In this case, the second container is filled by a powdered garnishing product such as cocoa or nuts.

Further characteristics and advantages of the invention will become apparent from the description which follows, purely by way of non-limiting example, with reference to the appended drawings, in which:

FIGS. 5 to 9 illustrate schematically the sequence of use of the package according to the invention.

Figure 1:
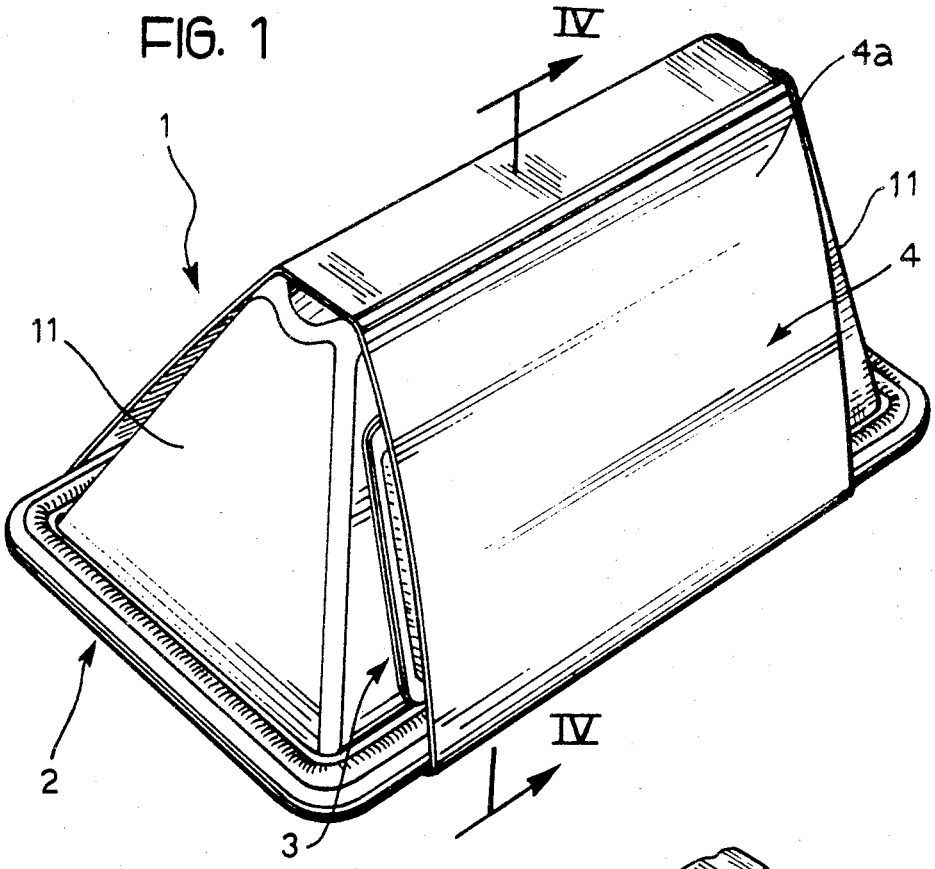
FIG. 1 is a perspective view of a package according to the invention.
Figure 3:
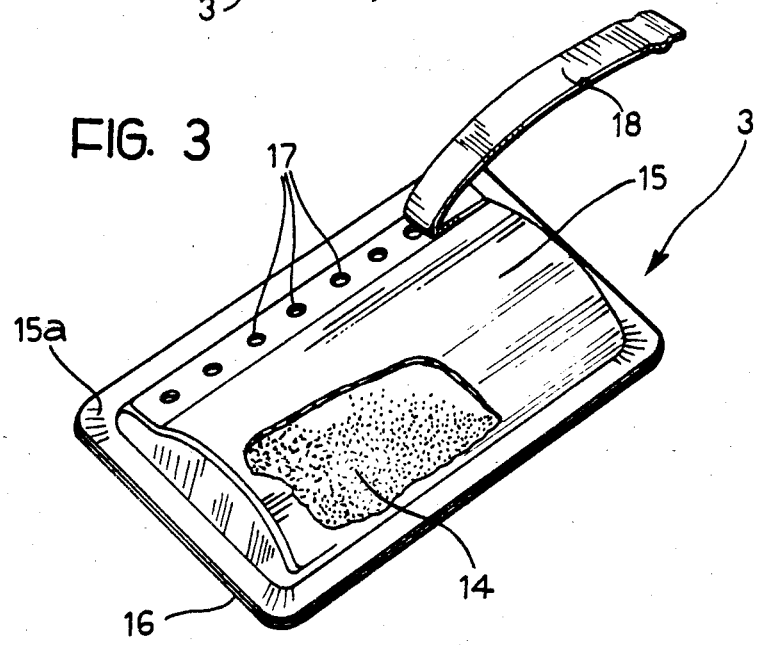
FIG. 3 is a perspective view illustrating in detail one of the elements illustrated in FIGS. 1 and 2.

In the drawings a package for food products, constituted in the currently preferred application by sweet products, is generally indicated 1.

The package 1 comprises essentially three elements, namely: a first container 2, a second container 3, and an annular or tubular wrapper of sheet material, indicated 4.

The first container is generally dish-shaped and contains a filling of a first food product 5 which is solid or solidifiable, by which is meant a "solid" or "solidified" product as well as a paste and the like.

For example, the product 5 may be a milk- and cream-based semi-liquid or liquid which can be solidified by cooling so as to make a final product much the same as conventional ice-cream products.

Around its rim, which is rectangular, the container 2 has a flange the larger straight parts and smaller straight parts of which are indicated *6a* and *6b* respectively.

A sealing plate 7 of foil material, such as aluminium, is applied to the flange 6 by, for example, ultrasonic welding. The flange 6 has a groove 8 which extends continuously around the flange itself. The groove 8 opens onto the surface of the flange 6 facing the sealing plate 7. The edge portion of the plate 7 is made to enter the groove 8 during fixing onto the flange 6, so as to secure the plate 7 firmly over the mouth of the container 2.

As will be explained better below in a description of the sequence of use of the package according to the invention, the sealing plate 7 is intended to be pierced or torn to allow access to the food product 5.

A further plate 9 of sheet material with a greater resistance to accidental compression or piercing than the plate 7 is normally applied to protect the plate 7.

The protective plate 9, normally a sheet of plastics material, is stuck to the outer surface of the plate 7 so as to be easily removed at the time of use to uncover the plate 7.

The container 2 has four flat side walls that are approximately trapezoidal and arranged in two pairs of identical, mutually opposing side walls which converge towards each other.

In the embodiment illustrated, there can be seen two larger side walls 10 substantially co-extensive with the larger parts *6a* of the flange 6 and two smaller end walls 11 substantially co-extensive with the other two parts *6b* of the flange 6.

In simple terms, the container 2 has an approximately frusto-pyramidal shape. The bottom of the container, indicated 12, defines the top of the frusto-pyramid and has a generally channel section which opens outwardly of the container 2 with its longitudinal axis parallel to the larger parts *6a* of the flange 6 and the larger side walls 10.

In more general terms, it may be stated that the side walls 10 and 11 are arranged in two distinct pairs, each pair comprising mutually opposing flat side walls which converge towards the bottom 12 of the container 2. More particularly, the planes identified by the walls 10 intersect each other along an imaginary line (line of convergence) which lies beyond the bottom 12 and extends parallel to the larger parts *6a* of the flange 6. The planes identified by the smaller walls 11 intersect each other along another imaginary line of convergence which lies beyond the bottom 12 and extends parallel to the smaller parts *6b* of the flange 6.

As a result of the general channel shape of the bottom 12, the regions connecting the side walls 10 and the bottom constitute outstanding straight edges 13 extending parallel to the larger parts *6a* of the flange 6.

Thus, the raised edges 13 can act as rest formations for the container 2 when it is located on a surface with its mouth facing upwardly.

Each of the walls 10 constitutes a substantially flat face defined at one side by one of the larger parts of the flange 6 and at the opposite side by the corresponding raised edge 13.

The second container 3 is generally flat and has dimensions slightly less than the dimensions of the larger side faces or walls 10 of the first container 2.

This is filled with a food product 14 intended to be applied as a garnish to the food product in the first container 2.

Typically, the product 14 is a cocoa- or nut-based powder intended to be sprinkled on the ice-cream product removed from the first container 2.

The second container 3 comprises a dish-shaped body 15 of flexible material. The body 15 has a flange 15*a* at its free edge, to which a flat plate 16 ensuring the closure of the container 3 is fixed, for example by gluing or ultrasonic welding.

The container 3 is generally rectangular and the dish-shaped body 15 has a more or less constant section in the form of a segment of a circle, in planes orthogonal to its larger sides, that is, the larger parts of the flange 15*a*.

The flexibility of the body 15 means that the container 3 can be rhythmically squeezed or compressed between two fingers in order to expel the garnishing product 14 through a plurality of holes 17 arranged along one of the sides of the body 15 adjacent one of the larger parts of the flange 15*a*.

In order to prevent the product 14 escaping from the second container 3 before use, a strip of adhesive material 18 is applied to seal the holes 17. The strip 18 may be removed easily at the moment of use, as will be better understood from the following. As can be seen from FIGS. 1 and 4, the container 3 is intended to be applied against one of the larger side faces 10 of the container 2.

Normally, it is the flat face of the container 3, that is, the one defined by the plate 16, which is brought into contact with the container 2. Adhesive elements such as a strip of double-sided adhesive tape 19 or spots of easily breakable glue are preferably located between the two containers. These adhesive elements are intended to prevent the container 3 from being accidentally detached from the container 2 during wrapping, transport and the like prior to the use, while allowing the user easily to separate the container with the garnishing product from the container with the product to be garnished at the moment of consumption by a simple manual action.

The shape of the two containers 2, 3 is such that the tubular wrapper 4, normally made by closing a cardboard strip into a ring, may be fitted over the container 2 carrying the container 3 on one of its faces 10.

Figures 2, 4:
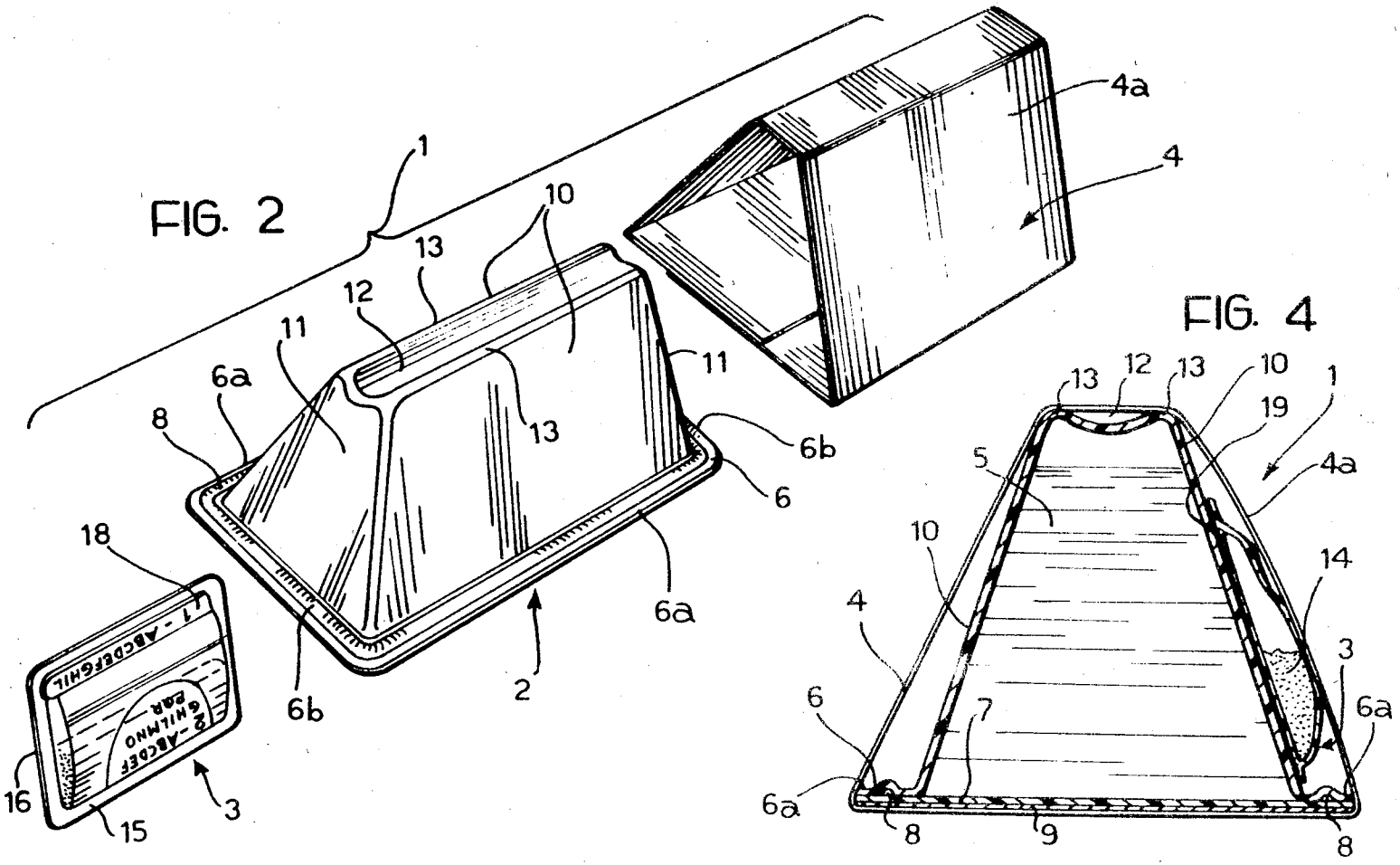
FIG. 2 is an exploded view of the package of FIG. 1.
FIG. 4 is a section taken on the line IV—IV of FIG. 1.
Figure 10:
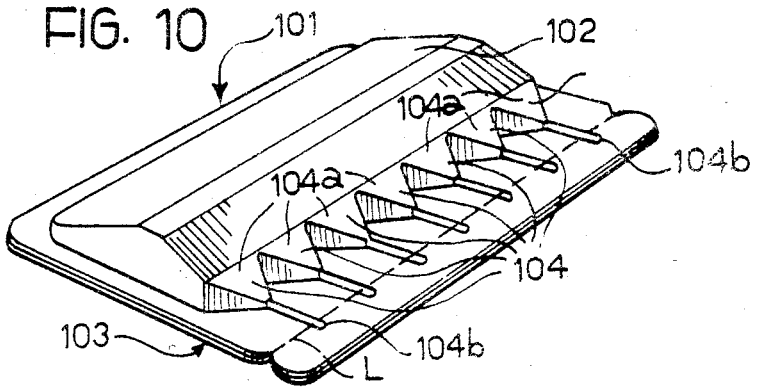
FIGS. 10 to 13 illustrate the structure and manner of use of a variant of the element illustrated in FIG. 3.

As seen in FIGS. 1 and 4, in its assembled disposition on the package, the wrapper 4 around the container 1 takes on an approximately trapezoidal form in section, which can be seen to be constituted by four sides. Two of these sides, corresponding to the bases of the trapezium, extend over the outer surface of the protective plate 9 closing the mouth of the container 2 and between the two raised edges 13, respectively.

Each of the other two sides of the wrapper, corresponding to the oblique sides of the trapezium, extend between one of the larger parts 6*a* of the flange 6 and the corresponding edge 13 to cover a respective side face 10 of the container 2. In particular, one of the latter two oblique sides, indicated 4*a*, extends so as to cover the second container 3 applied against the corresponding flat side face 10 of the container 2.

The container 3 is thus protected against any impact and/or sliding forces which could cause its accidental detachment from the container 2 before consumption.

The portion 4*a* of the wrapper 4 also affords some protection against squashing forces exerted on the second container 3 while it is still applied to the container 2. These forces could in fact cause accidental and unwanted expulsion of the garnishing product 14 before consumption.

The shape of the containers 2 and 3 is such that the wrapper 4 may be fitted easily over the container 2 by sliding it along the larger parts 6*a* of the flange 6 and along the raised edges 13.

To advantage, the wrapper 4 may also be used as a printing substrate for carrying instructions as to the sequence of use of the package, as well as identifying markings for the packaged product.

In the preferred application to sweet products which can be solidified by cooling, this sequence of use includes, as a first stage (FIG. 5), the exposure of the package 1 (or at least the first container 2 alone) to a low temperature.

This operation may be carried out easily by the placing of the package 1 (or the container 2 alone) in an ordinary freezer for a period of time sufficient to solidify the food product 5.

Once the food product 5 has solidified, the second container 3 is separated from the first container 2 after the removal of the protective tubular wrapper 4, as illustrated schematically in FIG. 6.

The wrapper 4, which is made from a sheet of card, may be torn easily; however, the shape of the parts described allows the wrapper 4 to be removed from the container 2 by sliding it along the larger parts 6*a* of the flange 6 and the edges 13.

As illustrated in the same FIG. 6, after the body 3 has been separated from the body 2, the adhesive strip 18 is removed or raised so as to uncover the holes 17.

Naturally, the two first steps in the sequence of use may also be reversed: the container 2 may in fact be freed from the wrapper 4 and the container 3 before being placed in the freezer to solidify the product 5.

In each case, it is preferable for the container 2 to be cooled with its mouth facing upwardly, the raised edges 13 being used as rests.

Under these conditions, the product 5, which is liquid or semi-liquid at ambient temperatures, tends to collect in the bottom of the container 2. As it changes to the solid state as a result of cooling, the product 5 thus adopts a shape which reproduces the shape of the internal surface of the bottom of the container 2, that is, an approximately pyramidal shape with a top surface or crest having a channel profile substantially the same as the profile of the bottom 12. As well as being agreeable from an aesthetic point of view, this profile allows a better and more uniform distribution of the garnishing product 14 to be obtained.

The container 2 with the solidified product 5 is then opened by the removal of the protective plate 9 and the piercing of the sealing plate 7 around the periphery of the mouth of the container 2.

As illustrated in FIG. 7, this operation may be carried out easily, for example by means of a knife C.

Subsequently, the solid product 5 is expelled from the container 2 and put on a plate or similar serving receptacle F (FIG. 8).

As schematically illustrated in FIG. 9, the product 5 is then garnished with the powder 14 in the container 3.

In order to effect the garnishing, the user grasps the container 3, pinching it between two fingers and holding it above the product 5 with the holes 17 (previously freed from the adhesive strip 18) facing downwardly.

The user then compresses the container 3 rhythmically: as a result of this compressive action, the garnishing powder 14 is expelled from the holes 17 and deposited on the product 5, particularly on the top or crest corresponding to the bottom 12 of the container 2.

The product 5, thus garnished, is ready to be eaten.

In FIGS. 10 to 13, a variant of the second container 3 for receiving the food product which is applied as a garnishing to the product 5, as shown schematically in FIG. 9 above, is generally indicated 101.

The container 101 comprises, as its constituent parts, a dish-shaped body 102 and a sealing plate or sheet 103 applied to close the dish-shaped body 102.

The body 102 and the plate or sheet 103 together define a hollow envelope for receiving the powdered food product 14.

The sheet 103 can be applied to close the free edge of the dish-shaped body 102 which, in the embodiment illustrated here, has a generally rectangular shape.

Both the body 102 and the sheet 103 are made from flexible plastics material.

The sheet 103 is preferably attached to the free edge of the body 102 by ultrasonic welding or heat sealing.

The flexibility of the material forming the dishshaped body 102 makes it resiliently compressible, enabling the internal volume of the envelope containing the powdered product 14 to be reduced. As already seen above with reference to the container 3, the compressibility of the dish-shaped body 102 allows the powdered product 14 to be ejected from the container 101.

Alone one of the sides of the free edge, the dish-shaped body 102 has a plurality of generally channel-shaped appendages, indicated 104.

More precisely, each of the appendages 104 (seven in the embodiment illustrated) is generally funnel-shaped with a flared mouth 104*a* which faces into the envelope 101 and communicates freely with the interior of the dish-shaped body 102.

At its opposite end, that is, outside the container 101, each appendage 104 has a portion 104*b* which is generally straight and ends at a certain distance from the outer margin of the free edge of the dish-shaped body 102.

Together with the sheet 103 applied to close the dish-shaped body 102, the appendages 104 thus define respective tubular ducts (or more precisely funnels) with corresponding internal ends (104*a*) communication with the interior of the dish-shaped body and corresponding outer ends (104*b*) which are sealed from the outside of the envelope 1.

Consequently, when the sheet 103 is applied to the body 102 into which the product 14 has previously been introduced, the envelope 101 constitutes a sort of flat packet which can be applied against one of the side walls 10 of the container 2, as illustrated (with reference to the container 3) in FIG. 4.

Figure 12:
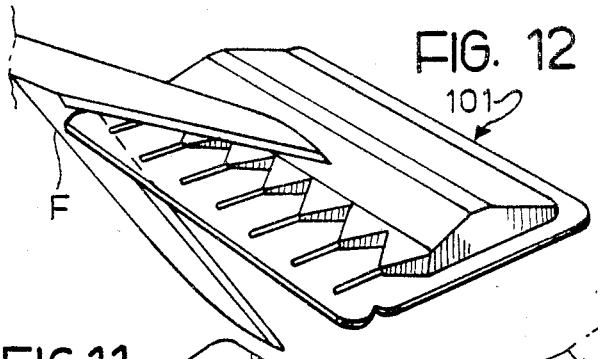

During use, that is to say, when it is wished to apply the product 14 as a powdered garnishing to the solid product 5 (FIGS. 8 and 9) after the container 103 has been separated from the container 2, the user cuts the container 101 along the side with the funnel-shaped appendages 104 by means of scissors F (FIG. 12).

More precisely, the cutting action is carried out along a line L (possibly identified by a broken line printed on the envelope 101) which passes through the appendages 104 at their narrow ends 104*b*.

As a result of this cutting action, the ends 104*b* of the funnel-shaped ducts defined by the appendages 104 are put into communication with the exterior of the envelope.

Figure 13:
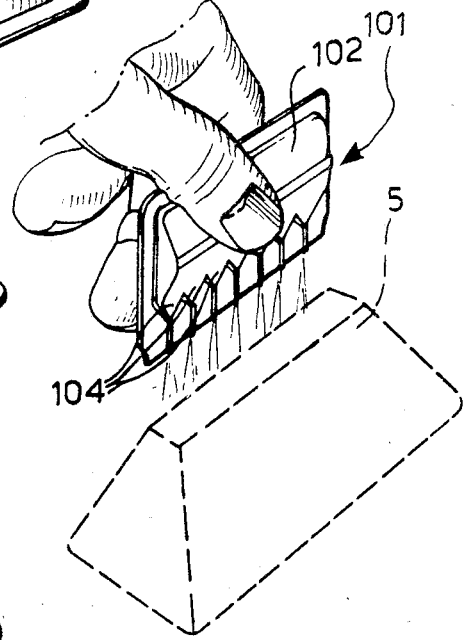
Figure 11:
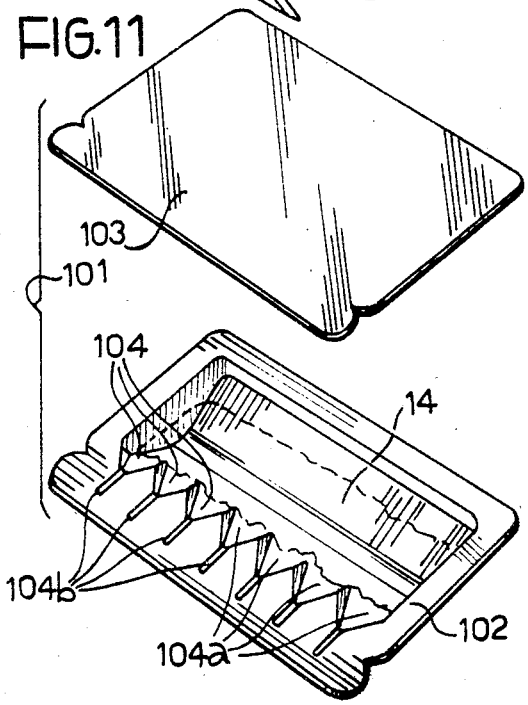

Each of the appendages 104 thus defines a respective funnel-shaped nozzle through which the product 14 may be dishcarged to the exterior of the envelope 101 and applied as a garnishing to the product 5, as shown schematically in FIG. 13.

During the delivery of the product, the user grips the envelope 101 between the thumb and forefinger of one hand and compresses it rhythmically.

As a result of the resilience of the material of the dish-shaped body 102, the envelope 1 contracts rhythmically causing, as a result of the reduction in its internal volume, the ejection of the product 14 to the exterior of the envelope L.

A jet of powdered garnishing product is thus ejected from each of the nozzles defined by the appendages 104.

Since the garnishing product is ejected through actual conical or frusto-pyramidal nozzles and not through simple holes in the walls of the envelope 101, the force and direction of the jet of garnishing material can be controlled precisely, avoiding useless dispersion around the product 5 which is garnished and the possible soiling of the surroundings.

What is claimed is:

1. Package for food products, comprising first and second containers for respective fillings of a solid or solidifiable food product and a food product usable as a garnishing for the solid or solidifiable product, wherein:

the first container is generally dish-shaped and has a flanged rim with a pair of opposing parallel straight sides, the first container further including a first pair of flat side walls which converge on each other towards a bottom of the first container in an arrangement in which planes containing the first pair of side walls intersect along an imaginary line extending parallel to said straight sides of the rim, the first container further including a straight bottom edge located adjacent the bottom of the container and parallel to the straight sides of the rim, one of said straight sides of the rim and said bottom edge together defining one flat side wall of said first pair of flat side walls, the first container further including a second pair of mutually opposing end walls;

the second container is generally flat and has dimensions such as to allow it to be applied against said one flat side wall of the first container, the second container being at least partly compressible in order to expel the garnishing product contained therein, and the containers have an associated tubular wrapper which can be fitted onto the first container with the second container applied to said one flat side wall, in an arrangement such that one section of this wrapper extends between a straight rim edge of said one straight side of the rim and the straight bottom edge to define a space together with said one of the flat side walls and said one of said straight sides of the rim, within which the second container fits, and to cover the second container, wherein the wrapper can slide over the first container parallel to the imaginary line of convergence of said walls.

2. Package as defined in claim 1, wherein:

said flanged rim further comprises a second pair of opposing parallel straight sides, and said end walls comprise a second pair of mutually opposing flat end walls, the walls of the second pair of walls converging on each other towards the bottom of the container in an arrangement in which planes containing the second pair of walls intersect along an ideal line extending parallel to the second pair of sides of the rim.

3. Package as defined in claim 2, wherein the flat side walls of the first container are larger than the end walls of the first container.

4. Package as defined in claim 2, wherein the first container has a ribbed bottom with raised parts which can act as rest formations for the first container.

5. Package as defined in claim 4, wherein the bottom of the first container has a channel section with a longitudinal axis parallel to one of the pairs of sides of the rim of the container.

6. Package as defined in claim 1, wherein the second container comprises:

a dish-shaped body which is resiliently compressible and has holes for the delivery of the garnishing product, a substantialy flat plate applied to close the mouth of the dish-shaped body, and removable sealing means applied to cover the holes.

7. Package as defined in claim 6, wherein:

the second container has a generally quadrilateral shape with at least two opposite straight sides parallel to each other, the dish-shaped body has an approximately constant section in the form of a segment of a circle, in planes perpendicular to said at least two opposite parallel sides, and the holes are aligned adjacent one of said at least two opposing parallel sides.

8. Package as defined in claim 1, wherein the second container comprises an at least partially flexible dish-shaped body which has a free edge and is closed by a sealing sheet applied to the free edge, and wherein the dish-shaped body has a plurality of channel-shaped appendages along part of its free edge, which define, together with the sealing sheet, respective tubular ducts having inner ends communicating with the interior of the dish-shaped body and outer ends sealed from the exterior of the second container the arrangement being such that, in use, the ducts can be opened to form respective nozzles for the discharge of the garnishing food product.

9. Package as defined in claim 8, wherein the channel-shaped appendages are generally elongate whereby the ducts can be opened by the cutting thereof in positions intermediate the respective inner ends and outer ends.

10. Package as defined in claim 9, wherein each of the tubular ducts is generally funnel-shaped with a mouth portion opening towards the respective inner end.

11. Package as defined in claim 1, wherein adhesive elements for retaining the second container in its applied position against said one flat side wall are interposed between the said one flat side wall of the first container and the second container.

12. Package as defined in claim 1, wherein the first container has an associated breakable or removable sealing plate the outer edge of which is fixed to the flanged rim.

13. Package as defined in claim 12, wherein the flanged rim has a groove defining a fixing seat for the sealing plate.

14. Package as defined in claim 12, wherein it includes a protective plate of foil removably applied to the outer surface of the sealing plate and having a greater resistance to tearing than the sealing plate.

15. Package as defined in claim 1, wherein the first container is filled with a food product which is liquid or semi-liquid and solidifiable by cooling, and the second container is filled with a powdered garnishing product.

16. Package for food products, comprising first and second containers for respective fillings of a solid or solidifiable food product and a food product usable as a garnishing for the solid or solidifiable product, wherein:

the first container is generally dish-shaped and has a flanged rim with first and second pairs of opposing parallel straight sides, the first container further including a first pair of mutually opposing flat side walls, the side walls of the first pair converging on each other towards the bottom of the container, in an arrangement in which the planes containing the first pair of side walls intersect along an imaginary line extending parallel to the first pair of sides of the rim, one of the flat side walls having a straight bottom edge located adjacent the bottom of the container and parallel to one straight side of the rim; the first container further including a second pair of mutually opposing flat end walls, the end walls of the second pair being smaller than said side walls of the first side wall pair and converging on each other towards the bottom of the container in an arrangement in which the planes containing the second pair of end walls intersect along an ideal line extending parallel to the second pair of sides of the rim;

the second container is generally flat and has dimensions such as to allow it to be applied against said one of the flat side walls of the first container, the second container being at least partly compressible in order to expel the garnishing product container therein, and the containers having an associated tubular wrapper which can be fitted onto the first container with the second container applied to said one of the flat side walls, in an arrangement such that one section of this wrapper extends between a straight rim edge of said one straight side of the rim and the straight bottom edge, to define a space together with said one of the flat side walls and said one straight side of the rim, within which the second container fits, and to cover the second container, wherein the wrapper can slide over the first container parallel to the imaginary line of convergence of the larger side walls.

* * * * *